US010138641B2

(12) United States Patent
Tabatabai

(10) Patent No.: US 10,138,641 B2
(45) Date of Patent: Nov. 27, 2018

(54) METHOD FOR RESTORING A STRUCTURE HAVING A CRACK BY FOLLOWING A CURVE REPRESENTING THE SEPARATION OF THE EDGES OF THE CRACK

(71) Applicant: ARMAN INNOVATIONS S.A., Luxembourg (LU)

(72) Inventor: Alain Tabatabai, La Celle Saint Cloud (FR)

(73) Assignee: ARMAN INNOVATIONS S.A., Luxembourg (LU)

( * ) Notice: Subject to any disclaimer, the term of this patent is extended or adjusted under 35 U.S.C. 154(b) by 0 days.

(21) Appl. No.: 15/039,149

(22) PCT Filed: Nov. 18, 2014

(86) PCT No.: PCT/EP2014/074838
§ 371 (c)(1),
(2) Date: May 25, 2016

(87) PCT Pub. No.: WO2015/078722
PCT Pub. Date: Jun. 4, 2015

(65) Prior Publication Data

US 2016/0362901 A1 Dec. 15, 2016

(30) Foreign Application Priority Data

Nov. 26, 2013 (LU) ..... 92314

(51) Int. Cl.
*E04G 23/02* (2006.01)
*E02D 3/12* (2006.01)
(Continued)

(52) U.S. Cl.
CPC ..... *E04G 23/0211* (2013.01); *E02D 3/12* (2013.01); *E02D 31/10* (2013.01); *E02D 37/00* (2013.01);
(Continued)

(58) Field of Classification Search
CPC ..... E02D 3/12; E02D 2250/003; E02D 31/10; E02D 37/00; E04G 23/0211; E04G 23/0203; E04G 23/0229
(Continued)

(56) References Cited

U.S. PATENT DOCUMENTS 4,567,708 A * 2/1986 Haekkinen ..... E02D 35/00 404/78
4,787,779 A * 11/1988 Clark ..... E02D 35/00 405/230
(Continued)

FOREIGN PATENT DOCUMENTS

EP 0851064 A1 7/1998
EP 1914350 A1 4/2008
(Continued)

OTHER PUBLICATIONS

International Search Report for PCT/EP2014/074838 dated Jan. 12, 2015.

*Primary Examiner* — Benjamin F Fiorello
*Assistant Examiner* — Edwin J Toledo-Duran
(74) *Attorney, Agent, or Firm* — Bachman & LaPointe, P.C.

(57) ABSTRACT

A method for restoring a structure resting on settled soil, deep soil being consolidated, the structure having at least one crack resulting from the settling of the soil, in which a reinforcement substance is injected into the foundation soil of the structure in line with the crack in a primary drilling hole, the method comprising simultaneously with the injection, acquiring a curve revealing edges of the crack being brought together, stopping the injection as soon as an abrupt reduction in slope in absolute value is detected on the curve.

16 Claims, 6 Drawing Sheets

(51) Int. Cl.
*E02D 31/10* (2006.01)
*E02D 37/00* (2006.01)

(52) U.S. Cl.
CPC ..... *E04G 23/0203* (2013.01); *E04G 23/0229* (2013.01)

(58) Field of Classification Search
USPC ..... 405/264, 266, 267, 269; 166/285–295; 404/75–80; 523/130–132
See application file for complete search history.

(56) References Cited

U.S. PATENT DOCUMENTS 4,906,140 A * 3/1990 Clark ..... E02D 35/00 405/230
5,369,675 A * 11/1994 Diaz ..... G01N 3/10 376/245
6,074,133 A * 6/2000 Kelsey ..... E02D 27/12 405/244
6,634,831 B2 * 10/2003 Canteri ..... E02D 3/12 405/263
6,663,321 B1 * 12/2003 Bisschops ..... E02D 5/46 175/20
2002/0098042 A1 7/2002 Canteri
2004/0037653 A1 * 2/2004 Kelso ..... E02D 27/48 405/236
2006/0010826 A1 * 1/2006 Canteri ..... E04B 1/648 52/741.4
2006/0086197 A1 * 4/2006 Chen ..... G01M 5/0025 73/862.451
2008/0225346 A1 * 9/2008 Mano ..... H04N 1/40 358/448
2009/0142713 A1 * 6/2009 Yamamoto ..... G03F 7/0035 430/325

FOREIGN PATENT DOCUMENTS

EP 1956147 A1 8/2008
GB 2278101 A1 11/1994
JP 2012038188 A * 2/2012

* cited by examiner

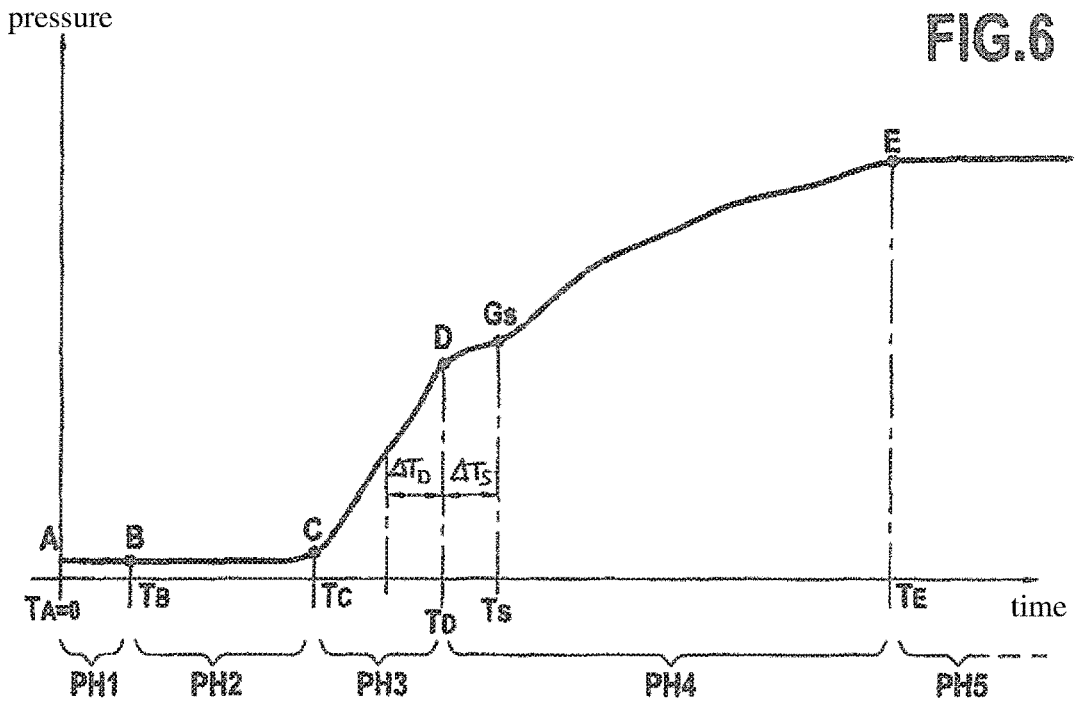
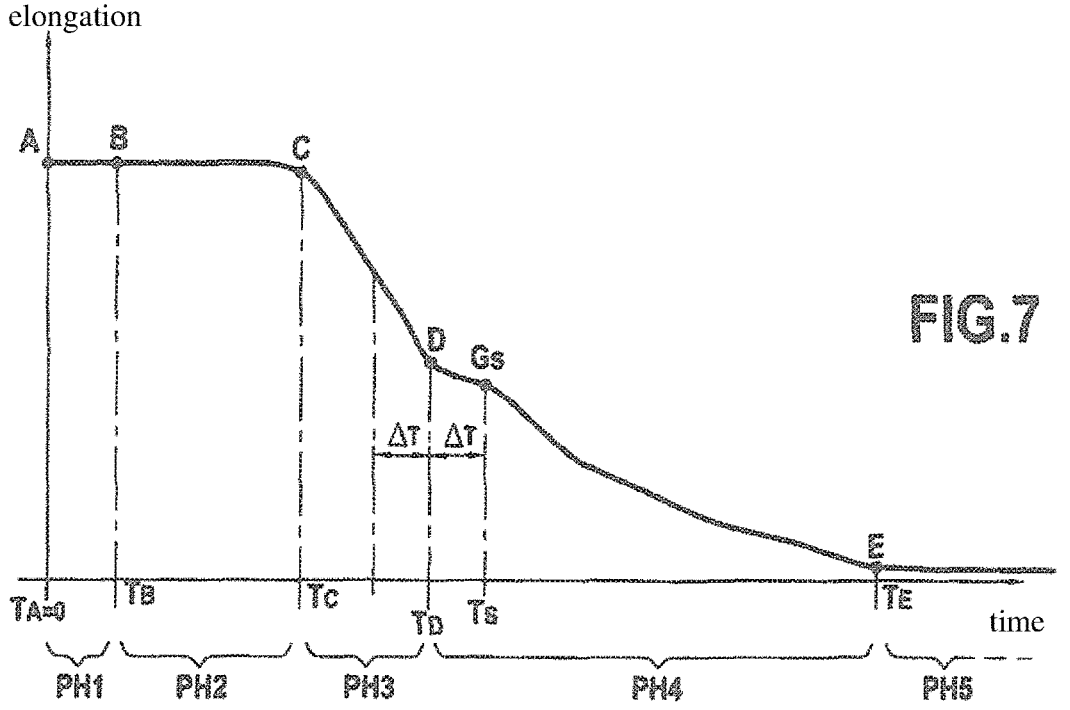
FIG.7

METHOD FOR RESTORING A STRUCTURE HAVING A CRACK BY FOLLOWING A CURVE REPRESENTING THE SEPARATION OF THE EDGES OF THE CRACK

BACKGROUND OF THE INVENTION

The present invention relates to a method for restoring a structure based on subsided ground, having at least one crack resulting from the subsidence of the ground.

More particularly, the invention concerns a method for restoring a structure resting on the ground, by treating its foundation soil by injecting an expandable substance in order to close said crack.

A crack appearing on a structure may be a sign of a rupture in the materials constituting the structure and occurs when the stresses caused in the structure concerned exceed the rupture limits from which it was designed.

Some cracks appear because of a sinking of the structure that then gives rise to parasitic stresses, that is to say tensile and/or compression stresses, normally non-existent on the intact structure but which have appeared following the shrinkage of the foundation soil of the structure, and may considerably weaken the structure and thus cause additional weaknesses and disturbances.

The causes of ground subsidence are many. It is generally a case of:

- a defect in initial bearing capacity,
- accidental decompression of the ground (following a pipe leak or the carrying out of uncontrolled earthwork, etc.).
- differential settling.

Following the phenomenon of settling, the structure undergoes a movement that results in the appearance of cracks in the superstructure as depicted in FIGS. 1, 3 and 5 for example. A part A of the structure follows the settling of the ground on which the structure of the building rests, referred to as the foundation soil and which will be defined in detail subsequently. On the other hand, other parts of the building B, often placed above the first, remain temporarily immobile in an unstable equilibrium, the two parts A, B being separated by cracks. This state of unstable equilibrium creates parasitic stresses that are often detrimental to the life of the structure.

In an ideal case, the works of reinforcement of the foundation soil and of the deeper soil should enable the structure to regain its initial state.

However, the diffusion of stresses in the soil depends on the depth in the soil and the effects of the reinforcement works on the closure of the cracks are also dependent on the depth at which the soil is reinforced.

Boussinesq's formula shows in fact that the stresses are located within a small radius around the vertical to the point of application of the load q for a depth z.

Thus, as depicted in FIG. 10, the diffusion takes place at an angle a with respect to the vertical, the stress sp being uniform inside the diffusion zone over a given horizontal plane.

The value $B_1$ is expressed:

$$B_1=B+2*z*tg\ \alpha$$

and hence $$o_2=q/(1+2*z/B*tg\alpha)$$

Generally a value of between 30° and 40° is adopted for α.

FIG. 9 shows schematically the diffusion of $\sigma_z$ with the depth from the previous equation.

We observe that, as from a depth of z~2 B, the value of $\sigma_z$ becomes less great in comparison with the loads provided by the structure on the ground. It converges towards zero for a depth of 8 B.

With regard to the settling of the ground, we can establish a direct relationship between the stresses and the deformations. In other words, the maximum settling value is obtained at the base of the foundations and this settling decreases with the depth in order to converge towards zero for a depth of 8 B.

Thus, according to the depth of the soil, two types of soil can be identified:

1. Foundation soil—this comprises a so-called foundation layer Z1 that is situated on the surface, that is to say immediately under the foundations of the structure, and any voids present between the foundation layer and the foundations of the structure. When there is poor bearing capacity, it is liable to suffer settling under the effect of a load and to cause damage in the structure. The foundation soil extends, in accordance with FIG. 3, over a depth of between "0", that is to say the bottom level of the foundations, and "2 B", the depth at which the stress $\sigma_z$ is around 0.2 $\sigma_0$, "B" being the width of the foundation element (base or slab) by means of which the load is exerted. The value of "2 B" may therefore for example be between 1.2 m and 2 m.

2. Deep soil—under the foundation layer, a deep layer Z2 is situated at a depth of between 2 B and 8 B. The stress $\sigma_z$ there is between 0.2 $\sigma_0$ and 0.01 $\sigma_0$ and is therefore negligible. At this depth, a layer of soil, even having poor bearing capacity, suffers less settling because of its relatively great depth vis-à-vis the applied load "q".

However, for a method for restoring a structure with a view to closing cracks therein to be effective, it is necessary to treat the part of the ground where the stress is maximum, that is to say the foundation soil.

However, it is necessary, before attempting to repair them in order to give the structure its original aspect, to ensure that the deep soil has sufficient bearing capacity.

And if the deep soil requires consolidation, it is necessary first of all to commence the treatment of this layer Z2 with any consolidation method: jet grouting (for injection of grout at high pressure), injection of microcement, or by the method described in European Patent EP 0 851 064 filed by the company Uretek, in accordance with which it is recommended injecting, in the deep soil (layer Z2), an expanding material, while controlling the moment when, following this injection, the building and/or the ground begins to rise.

The methods for restoring a structure having a crack do not therefore include the use of such a method of consolidation at depth.

They are used on the foundation soil including the foundation layer Z1, whereas the soil layer Z2 on which the layer Z1 rests is consolidated at depth, either because it has never suffered stresses that give rise to a loss of bearing capacity, or because it has been redensified following such stresses, or because it has been consolidated by suitable techniques.

For example, the traditional techniques of restoring a structure having a crack envisage, after reinforcement of the deep soil, a reblocking of the cracks after opening, and pinning and then refilling by means of a shrink-free mortar.

These techniques are however not satisfactory for the following reasons:

the part (A) that has suffered the settling remains sunk. Thus the proprietor of the property does not have his structure repaired in the same state as before the damage.

the filling between the part (A) and (B) often comprises a lack of levelling that is not aesthetically satisfactory.

the filling carried out from outside has its limits and does not ensure perfect contact between the elements (A) and (B).

and when the crack is situated on a wall of the structure clad with repetitive patterns, for example a tiled wall, the additional material breaks the repetition of the patterns and degrades the appearance of the wall in question.

And among the known methods concerning the injection of expanding substance in the foundation soil, the method described in the document U.S. Pat. No. 4,567,708 filed by the company Uretek in 1983 consists of returning a sunken slab to its original planar configuration by injecting an expanding material into the foundation soil. Provision is made from measuring the height of the slab before the additional injection. However, this document is completely silent on the way of closing a crack appearing on a wall supported by the deformed slab.

To overcome these drawbacks the invention proposes a method for reinforcement of the surface foundation soil of a structure, with a quality of finish not yet achieved, the deep soil previously having been reinforced by a suitable technique.

SUMMARY OF THE INVENTION

The objective of the present invention is therefore to provide a method for restoring a damaged structure, in particular a structure having at least one crack because of the settling of its foundation soil, making it possible both to improve the properties of the foundation soil of the structure and to neutralise any parasitic stresses caused by the settling of the soil, that appeared subsequently on the structure.

This objective is achieved with a method for restoring a slumped structure having at least one crack resulting from the settling, in which a reinforcement substance is injected into the soil of the structure (Z1) in line with said crack in a primary drilling hole, the method being characterised in that it also comprises, simultaneously with the injection, the acquisition of a curve revealing the bringing together of the edges of the crack, the injection being stopped as soon as an abrupt reduction in slope in absolute value is detected on the curve.

More precisely, when a substance reinforcing the soil is injected into the soil or at the interface between the soil and the foundation of the structure, in sufficient quantity and/or at sufficient pressure, said substance exerts, on the base of the cracked structure, an upward thrust that tends to close the crack in the structure, that is to say to bring together the bottom and top edges of the crack.

Initially, bringing the edges of the crack together is rapid, since these edges are not yet in contact.

As soon as the cracks come into contact, the bringing together the crack is suddenly braked. The start of contact between the edges of the cracks corresponds to a moment when the parasitic stresses exerted on the structure because of the sinking are neutralised. This is because, once the two edges are in contact, the loads of the top part (B) can descend satisfactorily towards the ground, as was the case initially.

According to the invention, it is therefore chosen to stop the injection as soon as this moment is detected.

It has been established that this moment can be detected easily by tracing the curve of variation of a parameter revealing when the edges of the crack are brought together, for example a curve of variation of movement or pressure.

Thus, according to an example of implementation of the method according to the invention, a sensor for a parameter revealing when the edges of the crack are brought together is placed between two points situated on the facade of the structure, on either side of the crack. The sensor is connected to a reading device and, simultaneously with the injection, the curve is read on the reading device.

The sensor may for example be a movement sensor suitable for measuring the edges of the crack when they are brought together.

According to an advantageous arrangement of the invention, the sensor makes it possible to detect infinitesimal movements, of around 10 microns.

The sensor may also be a pressure sensor suitable for measuring, between the edges of the crack, an increase in pressure revealing the edges being brought together.

In this case also, the variations in pressure are measured with a high degree of precision, for example around 0.005 bar.

At the moment when the edges of the crack come into contact, a curve as mentioned above exhibits an abrupt reduction in slope in absolute value.

By tracing the curve of a parameter revealing the edges of the crack being brought together, it is thus possible to determine with great precision the optimum moment for stopping the injection.

By virtue of these provisions, it is possible both to avoid the creation of excessive stresses in the structure (for example an excessive compression stress between the edges of the crack due to excessive injection), and to satisfactorily neutralise parasitic stresses due to the damage (by avoiding stopping the injection prematurely).

The method also allows the densification and improvement to the bearing capacity of the surface soil in the layer Z1 by means of the injection of the reinforcement substance, which increases the bearing capacity of the soil (in a soil of insufficient bearing capacity) and/or reduces its permeability in the case of a soil sensitive to hydric variations. Likewise, it makes it possible to fill the empty spaces between the soil and the foundation of the structure.

According to an example embodiment, in order to detect the abrupt break in slope signalling the stoppage of the injection, the slope of the curve is evaluated during a first interval of time $\Delta T_S$ and then during a second interval of time $\Delta T_D$, $\Delta T_S$ and $\Delta T_D$ being between 10 seconds and 2 minutes, preferably around 1 minute, and even more preferably 15 or 30 seconds.

It is considered for example that an abrupt reduction in slope is detected when the slope in absolute value over the second interval is less by more than 30%, preferably by more than 50%, than the slope in absolute value over the first interval.

On a cracked structure having a plurality of cracks, the method will generally be applied to those of said cracks that are most representative of the state of the structure in relation to a problem of settling of the ground.

More precisely, the first step will be to treat the part of the structure where the sinking is greatest, and, in this part, with the most significant cracks, that is to say the highest and widest, and the closest to the corners of the structure, and, among the most significant cracks, the most extensive.

And, when a crack is identified as being very extensive, when it has a length greater than 1 meter, it will be treated with multiple injections, either by beginning the injection vertically in line with the greatest separation in the crack, with a first injection point I, and then successive injection points J, J', K, K' in alternation of either side of this first injection point I, or by beginning the injection with a first injection point K situated at the first end of the crack in question, continuing the injection at a second injection point K' situated at a second end of this crack, and then with successive points J, J' in alternation on either side of the centre of the crack, in order to close it up progressively from its ends.

Preferably, the first drilling hole is situated in a plane substantially aligned with the sensor and perpendicular to the facade.

According to an advantageous provision, the reinforcement substance injected is an expanding substance, in particular polyurethane foam.

BRIEF DESCRIPTION OF THE DRAWINGS

The invention will be understood better from a reading of the following description of an embodiment of the invention given by way of non-limitative example, with reference to the accompanying drawings, in which:

FIG. 6 is a curve established by means of a pressure sensor fixed on either side of the crack;

FIG. 7 is a curve established with an elongation sensor fixed on either side of the crack;

DETAILED DESCRIPTION

In the first years of life of a structure, its foundation soil always settles a little under the effect of the loads (the inherent weight of the structure, permanent loads, operating loads). Settling under load is spoken of, distributed at every point on the structure.

In some cases, however, the settling is not the same at every point of the structure. Differential settling is spoken of.

The causes of this phenomenon may be many, either that the soil has been more compressible at certain points than at others, or that the loads applied to the structure have been unequally distributed, or again because of hydric variations in the soil due for example to the orientation (the faces oriented south and west suffer from more drying than the faces oriented north and east), to the close presence of tree roots absorbing water from the soil, to insufficient drainage, to leakages from systems, etc.

Figure 1:
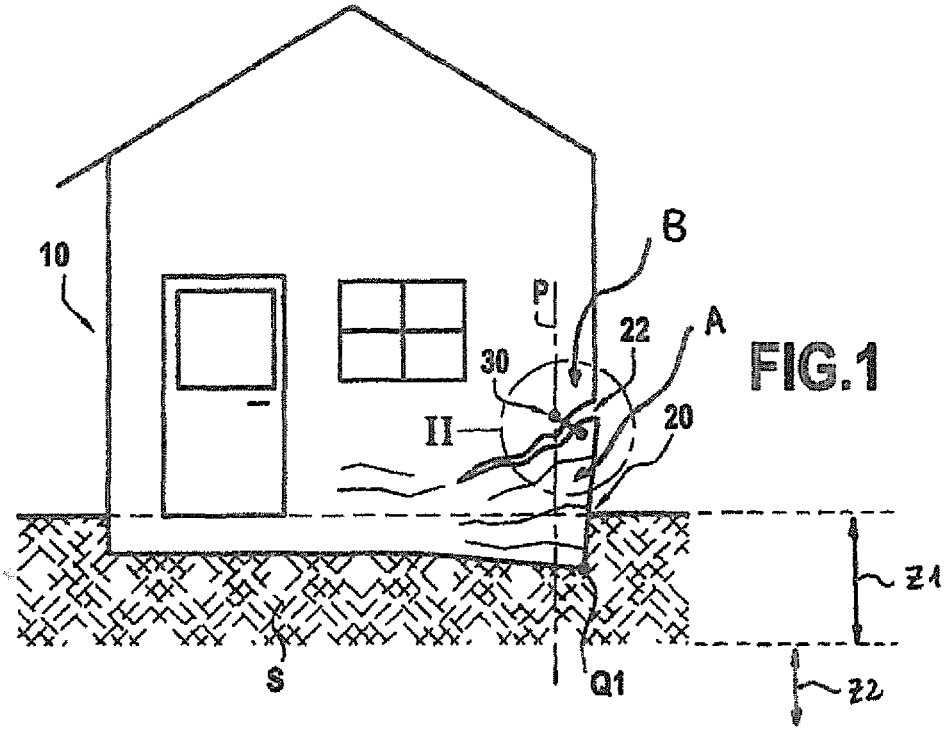
FIG. 1 is a schematic illustration of a damaged structure that can be restored by means of the method of the invention.

FIG. 1 depicts a detached house 10 where the foundation soil has suffered such differential settling. Significant settling of the soil is observed therein and, in fact, sagging of a bottom part A of the house 10, on its right-hand side, whereas a top part B remains at the same level as before the settling.

On this sagging side, the transmission of the loads from the structure to the ground is modified, the interface between the foundation base and the foundation soil being uncertain, or even non-existent in the case of the formation of an intermediate void between these two elements.

The response of the structure to the change in the transmission of loads from the structure to the ground, and to the parasitic stresses that result therefrom, results in a rupture with the cracking of the building, illustrated by the network of cracks 20 in FIG. 1.

An engineer specialising in construction can easily differentiate two types of crack: stabilised cracks, which do not affect the structure, and so-called "active" cracks which, on the other hand, give rise to parasitic stresses.

Generally, active cracks are situated above stabilised cracks.

Once the structure and the underlying soil have been stabilised after reinforcement following damage for example, the part of the structure where the sagging is the greatest will be treated as a priority, and in this part, with the most significant cracks, that is to say the highest and the widest, and the closest to the lateral ends of the structure (corners), and, among the most significant cracks, the most extensive.

When a crack is identified as very extensive, for example when it has a length greater than 1 meter, it will be treated with multiple injections, either commencing the injection vertically in line with the greatest separation in the crack, with a first injection point I, and then with successive injection points J, J', K, K' in alternation on either side of this first injection point I, or commencing the injection with a first injection point K situated at a first end of the crack in question, continuing the injection at a second injection point K' situated at a second end of this crack, and then with successive points J, J' in alternation on either side of the centre of the crack in order to gradually close it up, from its ends.

In FIG. 1 for example, it will be considered that the crack 22 is the most representative of the state of the structure.

To restore the damaged structure, three conditions must be satisfied.

A prior condition is that the deep soil, that is to say situated at a depth greater than 2 B, B being the width of the base supporting the structure, closest to the crack, has never suffered stresses that have given rise to a loss of bearing capacity, since it has been redensified or consolidated by appropriate techniques.

This preliminary condition must be fulfilled before the method according to the invention is implemented.

A second condition is the improvement and homogenisation of the properties of the soil S vis-à-vis the loads applied and/or hydric variations, in order to prevent a subsequent occurrence of new problems of differential settlings.

This second condition may be fulfilled by the injection into the soil of a reinforcing substance, in particular expanding substance, for densifying the soil and thus improving both its bearing capacity and its permeability.

A third condition is the neutralisation of any parasitic stresses caused in the structure because of the differential settlings and the rupture of the structure. This is because part of the superstructure could for example remain projecting.

The method according to the invention, the successive steps of which are described below, makes it possible to restore the damaged structure illustrated in FIG. 1.

Figure 2:
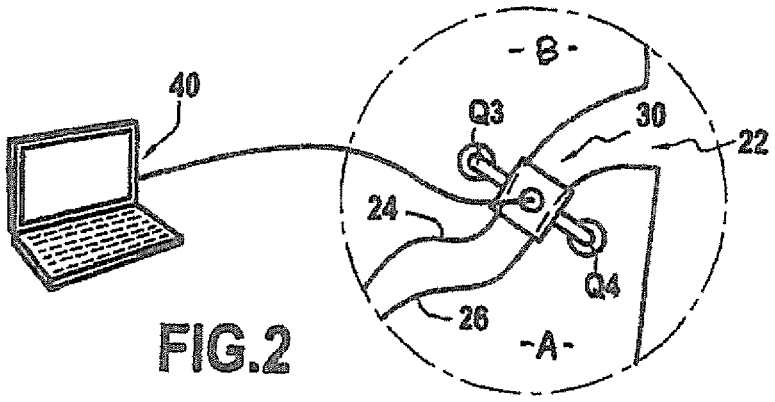
FIG. 2 shows a detail of implementation of the method according to the invention.
Figure 3:
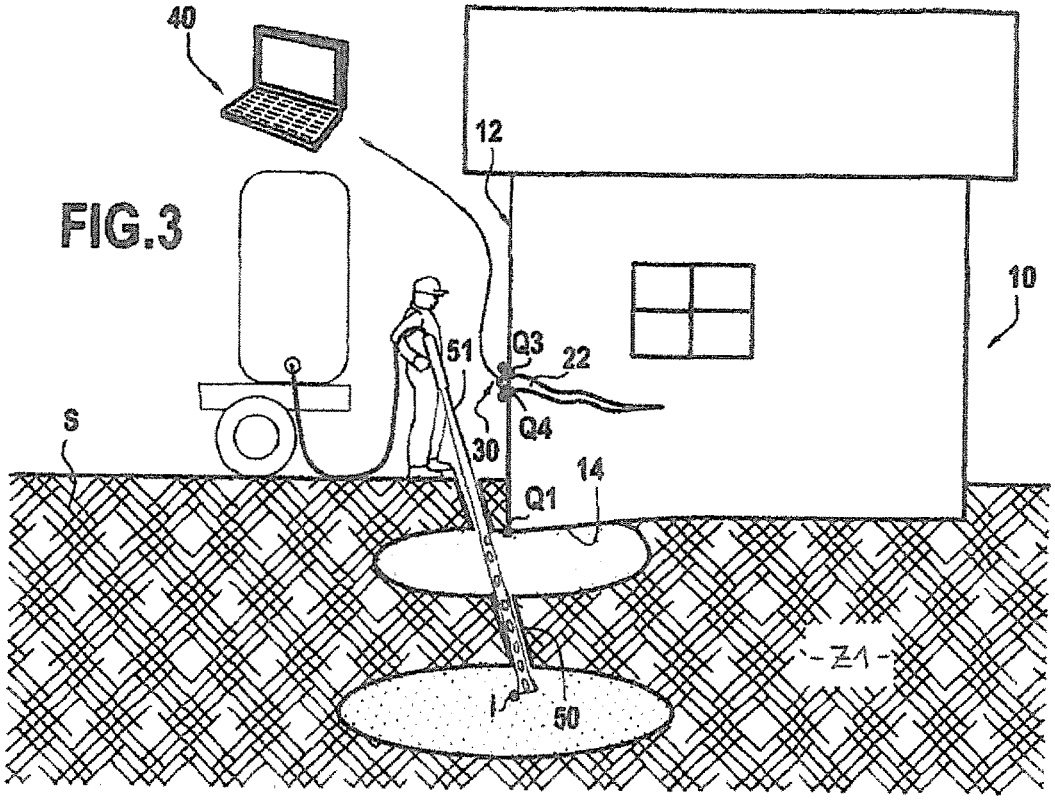
FIG. 3 shows the structure of FIG. 1 subjected to the method of the invention.

In a first step of the method illustrated in FIGS. 2 and 3, a force sensor 30 is placed on the facade of the structure, on either side of the crack 12, preferably perpendicular to the mean direction of the crack.

The force sensor 30 is for example a pressure detector, connected respectively at two fixed points Q3, Q4 situated on either side of the crack 22.

An increase in pressure measured by the sensor 30 means that the two edges 24, 26 of the crack 22 are tending to move closer together.

The pressure sensor 30 is connected to a reading device 40, here a computer, on which a first operator can read the curve illustrating the pressure values measured over time by means of the sensor 30.

Figure 5:
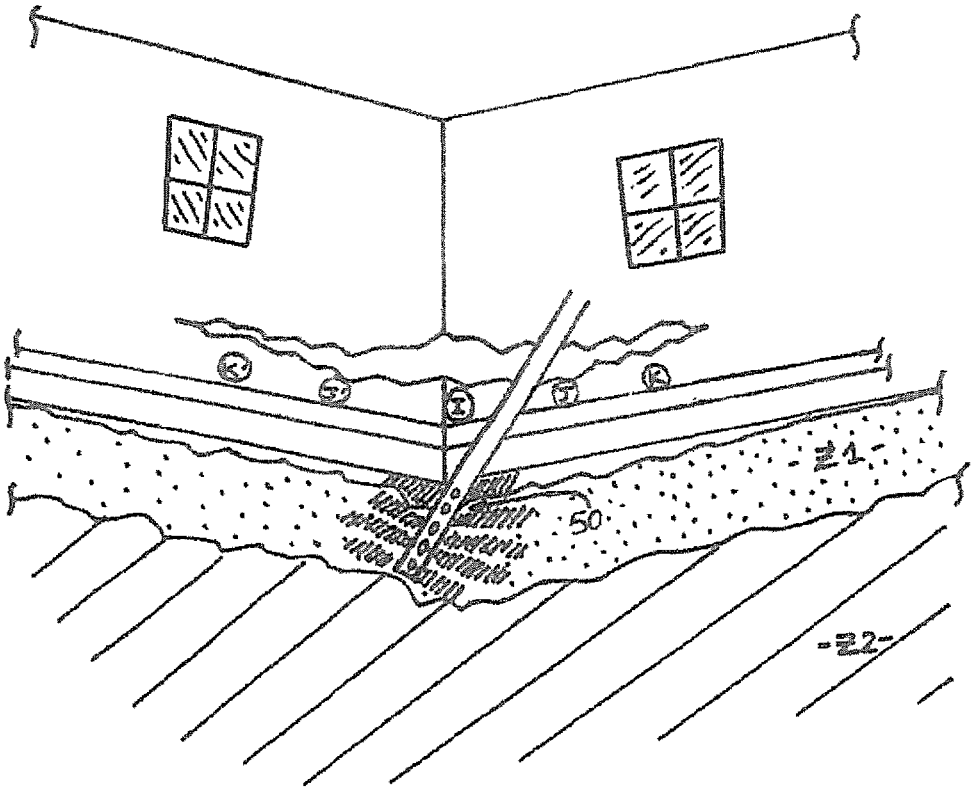
FIG. 5 illustrates schematically, by a perspective view, the drilling points that can be implemented in particular along extensive cracks according to an embodiment of the present invention.
Figure 8:
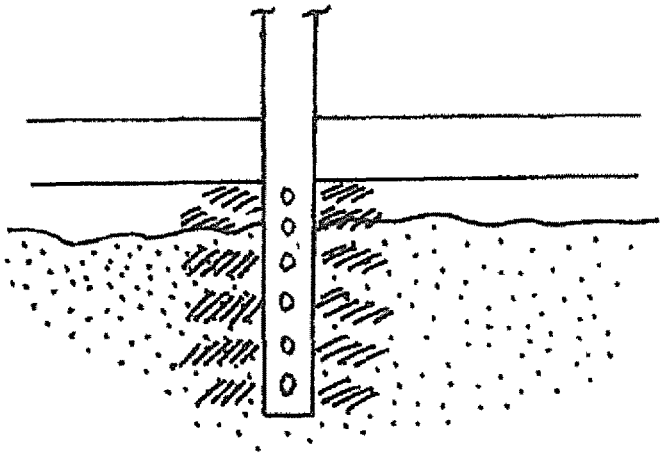
FIG. 8 illustrates schematically, by a view in cross-section, the foundation soil of a structure, comprising a void between the slab and a foundation layer Z1, and an injection lance with multiple orifices distributed along its axis to its end, and allowing distribution of the expanding substance in order to fill in the void and consolidate the layer Z1.
Figure 9:
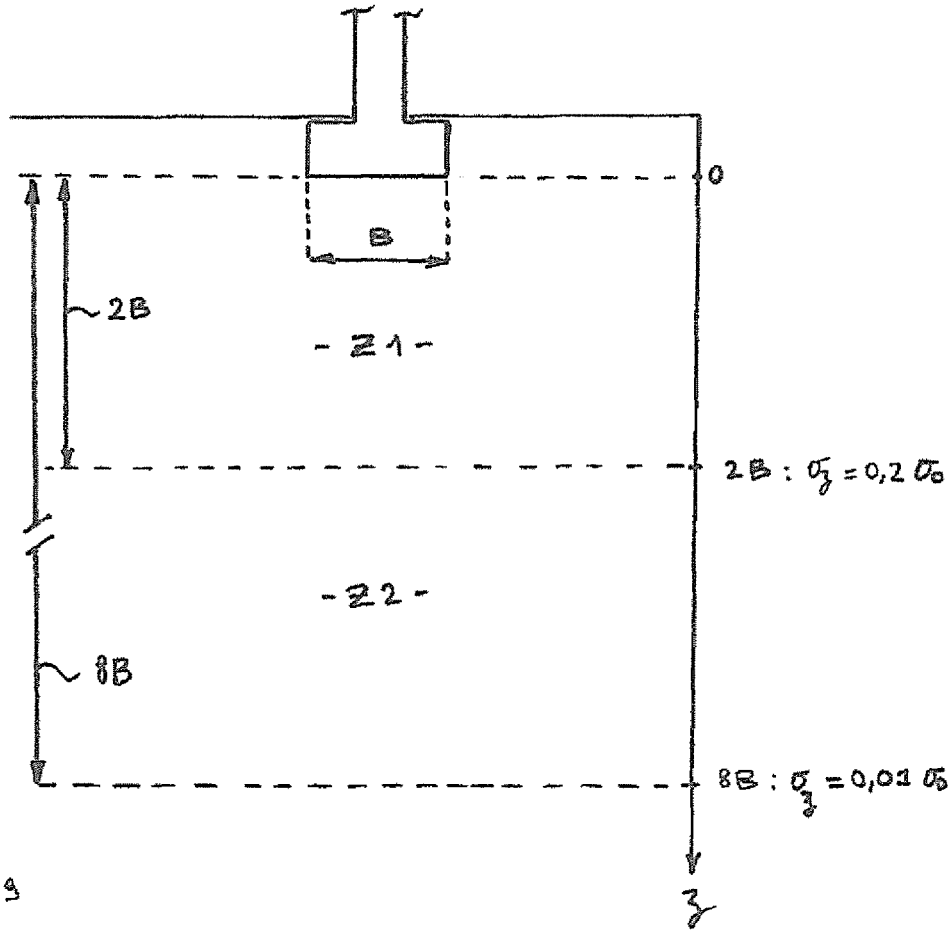
FIG. 9 depicts, by a schematic view in cross-section the soil vertically in line with a structure supported by a base, defining a foundation surface of depth z=0, a surface layer or foundation layer Z1 at a depth z of between 0 and 2 B, and a deep layer at a depth of between 2 B and 8 B.
Figure 10:
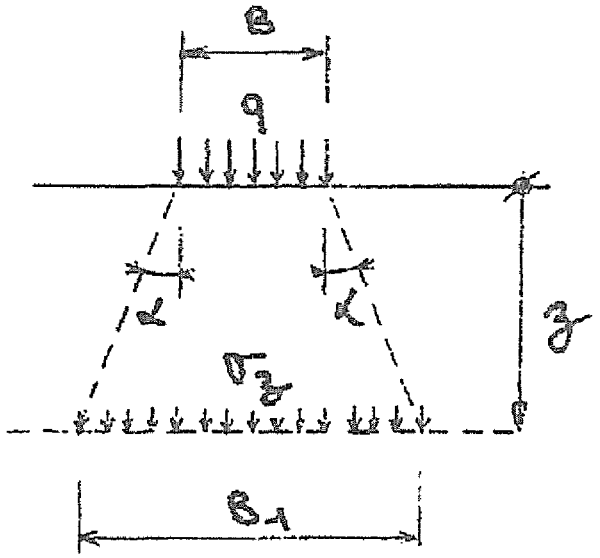
FIG. 10 depicts, by a schematic view, the distribution of the stresses $\sigma_z$ in the ground, under the effect of the application of a load "q".

In FIG. 5, which illustrates a particularly advantageous embodiment of the invention, a drilling hole 50 as wide as an injection lance is drilled in line with the crack 22, on slightly oblique path directed towards the inside of the building 10 in the direction of the layer of soil Z1.

This first drilling hole 50 is generally situated in a plane P perpendicular to the facade 12 of the structure 10 comprising the pressure sensor 30 (see FIG. 1) and is generally situated vertically in line with the maximum separation of the crack (often coinciding with the centre of the crack).

An injection lance 51 is inserted in the drilling hole 50: the lance 51 is positioned so that its bottom end is placed in the layer Z1 under the foundation base of the house 10. This lance 51 comprises, at its end penetrating the foundation soil, successive orifices in order to be able to spread the expanding substance above in the foundation layer Z1 and in any voids under the foundation existing between the base and the layer Z1.

Thus, as illustrated by the top bubble in FIG. 3, by means of the top orifices of the injection lance 51, the reinforcing substance is injected at the interface between the foundation base 14 and the soil S, in order to fill in the voids and to ensure that the loads are well transmitted between these two elements. Hereinafter, this step is referred as the "keying injection".

And as illustrated by the bottom bubble in FIG. 3, by means of the bottom orifices of the injection lance 51, the expanding substance is injected into the foundation layer itself Z1, an injection referred to as consolidation.

The consolidation injection is parameterised (volume of substance injected, injection pressure, coefficient of expansion of the reinforcement substance where applicable, phasing of the injections, etc.) so that the soil around the injection point is reinforced, and so that an upward thrust is exerted on the sunken base A of the structure in line with the crack to be treated.

In the example, the reinforcement substance is a polyurethane foam. Such a polyurethane foam is, for example, the result of a mixing of polyol and MDI isocyanate. On site, these two products are stored in a lorry in separate tanks. The two components are conveyed, through pipes, as far as the mixing gun of the spray lance. The association of the two products mixed under pressure with air blown in by a dual-component pump forms, by chemical reactions, an expanding foam that solidifies and acquires high mechanical characteristics.

Throughout the injection operation, a first operator continuously reads the curve displayed by the computer 40.

The curve in FIG. 6 gives the pressure values measured (on the Y axis) as a function of time (on the X axis).

It will be noted that the curve may be recorded either by a time sampling system (measured at regular intervals) or continuously.

The instant $T_A$=0 (point A on the curve) corresponds to the injection of the mixture of polyol and MDI isocyanate in the depth of the foundation soil using the injection lance 51. As from this instant, a certain amount of time is necessary for the reaction of the two components.

The preliminary phase, during which the foam has not begun its expansion and the foundation soil has not yet been moved, is denoted PH1 on the curve. The injection for the moment does not cause any change to the stresses exerted on the structure 10 which results in a first plateau PH1 on the curve recorded.

The instant $T_B$ (point B on the curve) corresponds to the start of the movements of the sunken part A of the structure because of the treatment of the foundation soil Z1. The lateral resistance of the soil being less than its vertical resistance (great because of the weight of the building), the foam propagates essentially laterally from the end of the injection lance 51. The grains of soil are reorganised among one another. The soil becomes more dense under the effect of the lateral thrust of the foam, but the level of the foundation soil for the moment remains unchanged. There also, no influence on the structure as measured. The pressure curve remains flat PH2.

The foundation soil, once compacted (point $T_C$ on the curve), offers increased resistance to the propagation of the foam in the horizontal direction. The resistance of the soil in the vertical direction finally becomes lower than its lateral resistance. The foam then tends to propagate upwards, generating, on the base of the structure 10, an upwardly directed thrust force. This thrust force naturally tends to lift the sunken part of the structure 10, gradually bringing the bottom edge 26 of the crack 22 closer to its top edge 24. The pressure measured by this sensor then increases very quickly, as illustrated on the curve by the phase denoted PH3. The point $T_C$ therefore corresponds to the start of the lifting of the part A.

After a moment, the increase in pressure takes place more slowly. This is because, at a time $T_D$ (point D on the curve), the curve shows a break in slope, which corresponds to the start of contact between the bottom and top edges of the crack. The injection is stopped as soon as the break in slope is detected. The injecting gun is cut off.

The variations in slope of the curve are evaluated continuously throughout the injection.

In practice, a skilled operator can stop the injection as soon as he detects with the naked eye a clear break in the slope of the curve, the slope decreasing in absolute value. To avoid any faulty interpretation, the operator generally waits until this change in the curve is confirmed in a predetermined interval of time, around ten seconds, for example between 15 and 30 seconds after the slope break point D, generally less than 1 minute.

In general, the operator will stop the injection when, at a time T, he has detected a reduction in the slope of at least 30%, preferably 50%, over an interval of time of less than 1 minute. This detection may also be carried out in automated manner, by means of suitable software.

In the example illustrated, the injection is stopped at a time $T_S$ (corresponding to a point $G_S$ on the curve), where the slope over a first interval $\Delta T_S$ is less by more than 30% than the slope of the curve over a previous interval of time $\Delta T_D$, $\Delta T_S$ and $\Delta T_D$ being less than or equal to 1 minute, for example 15 or 30 seconds.

Obviously stabilisation of the curve is not immediate, the foam continuing its expansion for a few moments after the gun is switched off. This is illustrated by a small and slow variation in pressure denoted PH4 in FIG. 6.

Finally, once the crack 22 is entirely closed, complete stabilisation of the pressure value measured is observed, identifiable by the level stage denoted PH5 on the curve.

Figure 4A:
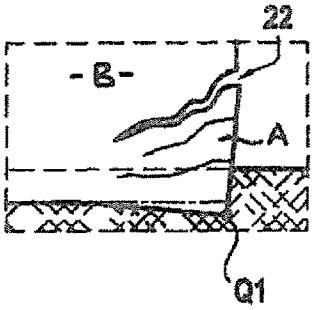
FIGS. 4A and 4B illustrate a crack in the structure respectively before and after the implementation of the method.
Figure 4B:
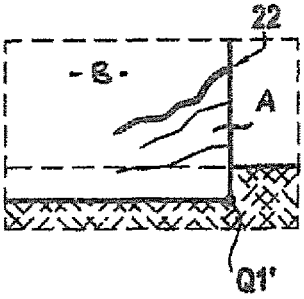

FIG. 4B illustrates the crack 22 once the consolidation injection has ended. The low point Q1 of the structure has risen again to its original level Q1'.

If the crack in question extends over a great length, for example 1 meter or more, and if despite a first injection in accordance with the above method a separation between the edges of the crack remains at a certain distance, additional injection operations are then continued at other injection points J and J' and than K, K' situated on either side of the first drilling hole I and in the regions that are situated vertically in line with the crack in question, in accordance with FIG. 5.

The other injection points J, J', K, K' adjacent to the first injection point I are, according to a first embodiment, effected in drilling holes produced in alternation to left and right of the primary drilling hole 50, following substantially the facade 12 of the building 10. The drilling holes are spaced apart from the first drilling holes 50 and from each other by a predetermined constant distance D, for example equal to one meter.

No injection will be carried out at more than 1 meter from the two points that are situated respectively vertically in line with the two ends of the crack.

According to another embodiment of the method according to the invention, the sensor used may be a movement (elongation) detector, in particular an optical-fibre detector providing detection of movements to within 10 microns.

The force curve obtained in such a movement sensor is illustrated in FIG. 7. It is the mirror of FIG. 6 described previously. The elongation measured by a sensor fixed respectively at a point on the bottom part of the crack and a point on the top part of the crack changes in fact inversely with respect to the pressure measured between the edges of the crack: when the pressure increases, the elongation decreases and vice-versa.

The phases PH1 to PH5 are shown on the curve in FIG. 7. All comments made previously relating to FIG. 6 apply mutatis mutandis to this.

It is found that, after a first level stage, corresponding to the expansion of foam and at the start of the consolidation of the soil, the curve has a high slope, testifying to the rapid bringing together of the edges of the crack. When the edges come into contact, the bringing together becomes slower and the slope of the curve (in absolute value) decreases abruptly.

According to the invention, the injection in the first drilling hole is stopped as soon as the abrupt reduction in slope in absolute value (point D) is identified.

The invention claimed is:

1. A method for closing at least one crack appearing on a structure resting on settled soil, the at least one crack resulting from settling of the soil comprising:

a preliminary step of consolidating a deep soil by a technique applied to a deep layer Z2 situated at a depth of between 2 B and 8 B, B being the width of said structure, said suitable technique including, in said deep layer Z2, at least one of a jet grouting, an injection of microcement, and an injection of an expanding material, a main step of lifting a base of the cracked structure by means of injection of a reinforcement substance into foundation soil of the structure applied to a foundation layer situated on the surface and extending over a depth of between 0 and 2 B, said injection being made in line with said at least one crack in a primary drilling hole, the method comprising simultaneously with the injection, acquiring in real time a curve revealing edges of the at least one crack being brought together, stopping the injection as soon as an abrupt reduction in slope in absolute value is detected on the curve.

2. The method according to claim 1, wherein the reinforcement substance is an expanding substance, said expanding substance comprising a polyurethane foam.

3. The method according to claim 2, wherein at each time T, the slope of the curve is evaluated during a first time interval and then during a second time interval, wherein said first time interval and said second time interval comprise between 10 seconds and 1 minute.

4. The method according to claim 3, wherein a sensor, with a parameter revealing the edges of the crack moving together, is placed between two points situated on facade of the structure, on either side of the crack, said sensor being connected to a reading device, and, simultaneously with the injection, reading said curve on the reading device.

5. The method according to claim 4, wherein the sensor is a pressure sensor suitable for measuring, between the edges of the crack, an increase in pressure revealing the edges moving together.

6. The method according to claim 4, wherein the sensor is a movement sensor suitable for measuring the edges of the crack moving together.

7. The method according to claim 6, wherein the primary drilling hole is situated in a plane substantially aligned with the sensor and perpendicular to the facade.

8. The method according to claim 7, wherein additional injections are carried out in drilling holes produced in alternation on either side of the primary drilling hole, moving away from said primary drilling hole.

9. The method according to claim 8, wherein at each additional injection, the injection is stopped as soon as it is no longer possible to inject.

10. The method according to claim 9, wherein once the injections in the drilling holes have ended, the bearing capacity of the soil is measured.

11. The method according to claim 10, wherein the structure is supported by a structure element, said structure element comprising at least one of a slab resting on the foundation soil and a base resting on the foundation soil, the injection of the reinforcement substance being done between at least one of the structure element and the foundation soil and in a layer of soil supporting the structure referred to as a foundation layer.

12. The method according to claim 1, wherein the reinforcement substance injection is parameterized so that the soil around the injection is reinforced, and so that an upward thrust is exerted on a sunken base of the structure in line with said at least one crack to be treated.

13. The method according to claim 1, wherein when a crack is identified as very extensive, the crack identified is treated with multiple injections, at least one of, commencing an injection vertically in line with a greatest separation in the crack identified, with a first injection point I, and then with successive injection points J, J', K, K' in alternation on either side of the first injection point I, and commencing the injection with a first injection point K situated at a first end of the crack identified, continuing the injection at a second injection point K' situated at a second end of the crack identified, and then with successive points J, J' in alternation on either side of a centre of the crack identified in order to gradually close the crack identified, from the first and second ends of the crack identified.

14. The method according to the claim 1, wherein during the main step, an injection lance comprising successive orifices defining top and bottom orifices is inserted in a drilling hole, said reinforcing substance being injected during a keying injection step, by means of said top orifices of said injection lance at the interface between a foundation base and a soil S, in order to fill in voids and to ensure that loads are well transmitted between said foundation base and said soil S, and said reinforcing substance being injected during a consolidation injection step, by means of said bottom orifices of said injection lance into said foundation layer itself.

15. A system for restoring a structure resting on a sunken foundation soil, the sunken foundation soil at a depth being consolidated, the structure having at least one crack resulting from the sinking of the sunken foundation soil, comprising:

a sensor configured to measure longitudinal edges of the at least one crack moving together, a consolidation device for consolidating the soil by a technique applied to a deep layer Z2 situated at a depth of between 2 B and 8 B, being the width of said structure, said technique including, in said deep layer Z2, at least one of a jet grouting, an injection of microcement, and an injection of an expanding material;

an injection device for injecting a reinforcement substance in the foundation soil of the structure applied to a foundation layer situated on the surface and extending over a depth of between 0 and 2 B, and lifting the cracked structure, in line with the crack, or between the foundation soil and a structure element supporting the structure, such as a slab or a base, the substance having, in an expanded state, a density comparable to that of the soil before the soil sank, an acquisition device for acquiring data issuing from the sensor in the form of a curve revealing the edges of the crack moving together, a controlling device for controlling stoppage of the injection, said controlling device configured to collect, in real time, the curve issuing from the acquisition device and configured to control stoppage of the injection as soon as an abrupt decrease in slope in absolute value is detected on the curve.

16. The system according to claim 15, wherein a density of the reinforcement substance is greater than 60 $kg \cdot m^{-3}$.

* * * * *